US006446731B1

(12) United States Patent
Sorosky

(10) Patent No.: US 6,446,731 B1
(45) Date of Patent: Sep. 10, 2002

(54) SMOKE EVACUATING FIRE VEHICLE

(75) Inventor: Joseph J. Sorosky, Longmont, CO (US)

(73) Assignee: Joseph J. Soroski, Longmont, CO (US)

( * ) Notice: Subject to any disclaimer, the term of this patent is extended or adjusted under 35 U.S.C. 154(b) by 0 days.

(21) Appl. No.: 09/742,843

(22) Filed: Dec. 20, 2000

(51) Int. Cl.[7] ..... A62C 27/00

(52) U.S. Cl. ..... 169/24; 169/43; 169/46; 169/25; 169/52; 169/67; 169/68; 169/70; 169/91; 239/271

(58) Field of Search ..... 169/43, 46, 24, 169/25, 67, 52, 68, 70, 54, 62, 91; 239/271

(56) References Cited

U.S. PATENT DOCUMENTS 667,149 A * 1/1901 Kenney
1,874,573 A 8/1932 Moore
1,926,298 A 9/1933 Moore
2,078,580 A 4/1937 Moore
2,120,563 A 6/1938 Lamb
2,857,005 A * 10/1958 Medlock
4,170,264 A * 10/1979 Gibson
4,187,913 A * 2/1980 Wilcox
4,311,198 A * 1/1982 Vasquez
4,886,233 A 12/1989 Bateman et al. ..... 248/647
4,986,364 A 1/1991 Clark ..... 169/48
5,301,756 A * 4/1994 Relyea et al.

* cited by examiner

*Primary Examiner*—Robin O. Evans
(74) *Attorney, Agent, or Firm*—James K. Poole, Esq.

(57) ABSTRACT

A mobile self-propelled vehicle for fighting fires incorporates an extensible, trainable evacuation tube which can be introduced into a burning building or other enclosed space to remove smoke and gases by means of a power exhaust fan. Fire extinguishing materials can be injected into the space through the same evacuation tube.

24 Claims, 9 Drawing Sheets

SMOKE EVACUATING FIRE VEHICLE

BACKGROUND OF THE INVENTION

1. Field of the Invention

The present invention relates to methods and apparatus for removing smoke and gases from enclosed areas where fires are being fought, particularly apparatus mounted upon self-propelled fire-fighting vehicles.

2. Description of the Relevant Art

Ventilation techniques can be used in fire fighting to control the movement of air and smoke as well as hot, flammable or hazardous gases. Proper ventilation can serve many purposes. For example, with small fires, ventilation can exhaust smoke to minimize smoke damage to property. With larger, more serious fires, exhausting smoke can reduce the risk of personal injury to both firefighters and occupants of the burning structure. Proper ventilation can remove hot air and combustible gases, thus slowing the spread of the fire. Even in "non-fire" emergencies, ventilation can remove toxic and/or flammable gases arising from various sources.

Fighting and extinguishing fires in enclosed structures such as buildings often requires the firefighters to enter such areas to rescue occupants and/or to take more effective steps to fight the fire directly. However, the presence of smoke and gases in enclosed areas where fires are burning makes it very difficult for the firefighters to find their way inside, and breathing and protective apparatus must often be used, which limits the time such personnel can spend in actual firefighting. This is particularly difficult for "blind" fires, which may be defined as fires originating from sources that cannot be seen or located precisely, and which yield large quantities of smoke and gases. It would thus be desirable to evacuate or dissipate such smoke and gases from the area where firefighters are required to enter, to improve their effectiveness and provide for their safety while performing their duties. Furthermore, most fires burn upwardly in confined spaces, thus igniting and burning through the floors above. It is often necessary to send firefighters to the roofs of burning buildings to open spaces to ventilate the fire, thus creating personnel hazards. It would be desirable to reduce the tendency of the flames to move upward and avoid the necessity of roof ventilation.

A few patents can be found for apparatus designed to achieve these ends.

U.S. Pat. No. 2,120,563 discloses a fire truck mounting a compressor and other equipment designed to introduce compressed air into a confined space to expel smoke and gases, with the flow of air thereafter to be reversed to provide fresh air to the space.

L. C. Moore has at least three patents in this area of interest. His U.S. Pat. No. 1,874,573 discloses a portable fan and hood system which can be attached to a ground level window or other aperture of a burning building to withdraw smoke and gases. U.S. Pat. No. 1,926,298 discloses a fire truck carrying a blower and a long, flexible hose which can be introduced into a window or other opening in a burning building to withdraw smoke and gases. U.S. Pat. No. 2,078,580 discloses a similar fire truck carrying a power exhauster attached to an extensible smoke stack. Portable conduits can be attached to the smoke stack in sections.

Clark discloses a dual purpose fire fighting and ventilation apparatus in U.S. Pat. No. 4,986,364. The apparatus includes a rigid conduit which can be connected to a water source at one end and a nozzle at the other. The nozzle end is inserted into a window of a burning building and water is directed through the conduit and nozzle, which is directed to spray outwardly through the window. The result is an aspiration effect which draws smoke and gases out of the building. When enough smoke has been withdrawn, the nozzle can be repositioned and the flow of water redirected to attack the source of the fire directly.

Bateman and Panter disclose another fire fighting ventilation system in U.S. Pat. No. 4,886,233 which is a portable apparatus for supporting and operating ventilation fans. Wheels and adjustable legs and arms are provided to allow the fans to be positioned on uneven surfaces so as to evacuate smoke from accessible areas of burning buildings, preferably directing the flow out a window or the like.

Despite these early efforts, fire fighting is an evolutionary science, with efforts continuing to develop apparatus and methods to improve the effectiveness of fighting fires in various enclosed spaces. In some cases, modern construction materials and methods as well as the contents of various buildings have complicated the tasks of fire fighters. For example, many synthetic fabrics and construction materials used in modern buildings produce voluminous, dense smoke and toxic gases while burning. There is clearly a need for improved apparatus for evacuating smoke and gases from burning buildings and other enclosed spaces.

SUMMARY OF THE INVENTION

It is thus an object of the present invention to provide a mobile, self-propelled apparatus capable of removing smoke and gases from burning buildings or other enclosed spaces. Another object of the invention is to provide a self-propelled vehicle which can be positioned close to such burning buildings and provide a stable platform for apparatus to withdraw the smoke and gases. A related object of the invention is to provide a stable foundation for the apparatus when positioned close to a burning structure. A further object of the invention is to provide an extensible channel to penetrate the burning building and a powered exhaust system to remove the smoke and gases. Another object of the invention is to provide means for injecting fire extinguishing materials into the building once the smoke has been evacuated.

In accordance with the present invention, a mobile self-propelled evacuating fire vehicle is provided, comprising an extensible evacuation tube operatively connected to mechanical suction means and including means for positioning the tube for entry into a window or similar opening in a burning structure. Preferably, the evacuation tube can be extended and retracted by remotely-controlled power means to facilitate insertion into or withdrawal from such a window. The positioning means can include mechanical means for training the tube laterally, as with a rotary turret, and means for elevating and depressing the tube above and below the horizontal plane. The entry end or nose cone of the tube can be fitted with doors which can be opened and closed, again preferably by remotely-controlled power means. The entry end or nose cone can also be fitted with remotely-controlled power means for adjusting its aim in both lateral and vertical directions so as to aim the open doors in the most effective direction. This is particularly helpful when the tube is equipped with hoses or other channels to carry firefighting materials such as water or chemicals to the entry end of the tube and propel them toward the source of the fire. The vehicle should have sufficient wheels or other drive means to support each corner of the vehicle, and at least two drive wheels or other drive means. To facilitate movement through wet or slippery terrain, the vehicle should have all-wheel drive or the equivalent. Additionally, to facilitate providing a stable base for movement of the tube, the vehicle preferably has at least one wheel on each side which can be extended laterally and positioned vertically to support the vehicle, even on sloping or irregular terrain. The vehicle includes a prime mover for its own propulsion and power take-offs or auxiliary power units to meet all the energy needs involved in manipulating and exerting suction with the evacuation tube.

Additional objects and advantages of the present invention are described in, and will be apparent from, the following detailed description of preferred embodiments together with the drawings and appended claims.

DETAILED DESCRIPTION OF THE PREFERRED EMBODIMENTS

Figure 1:
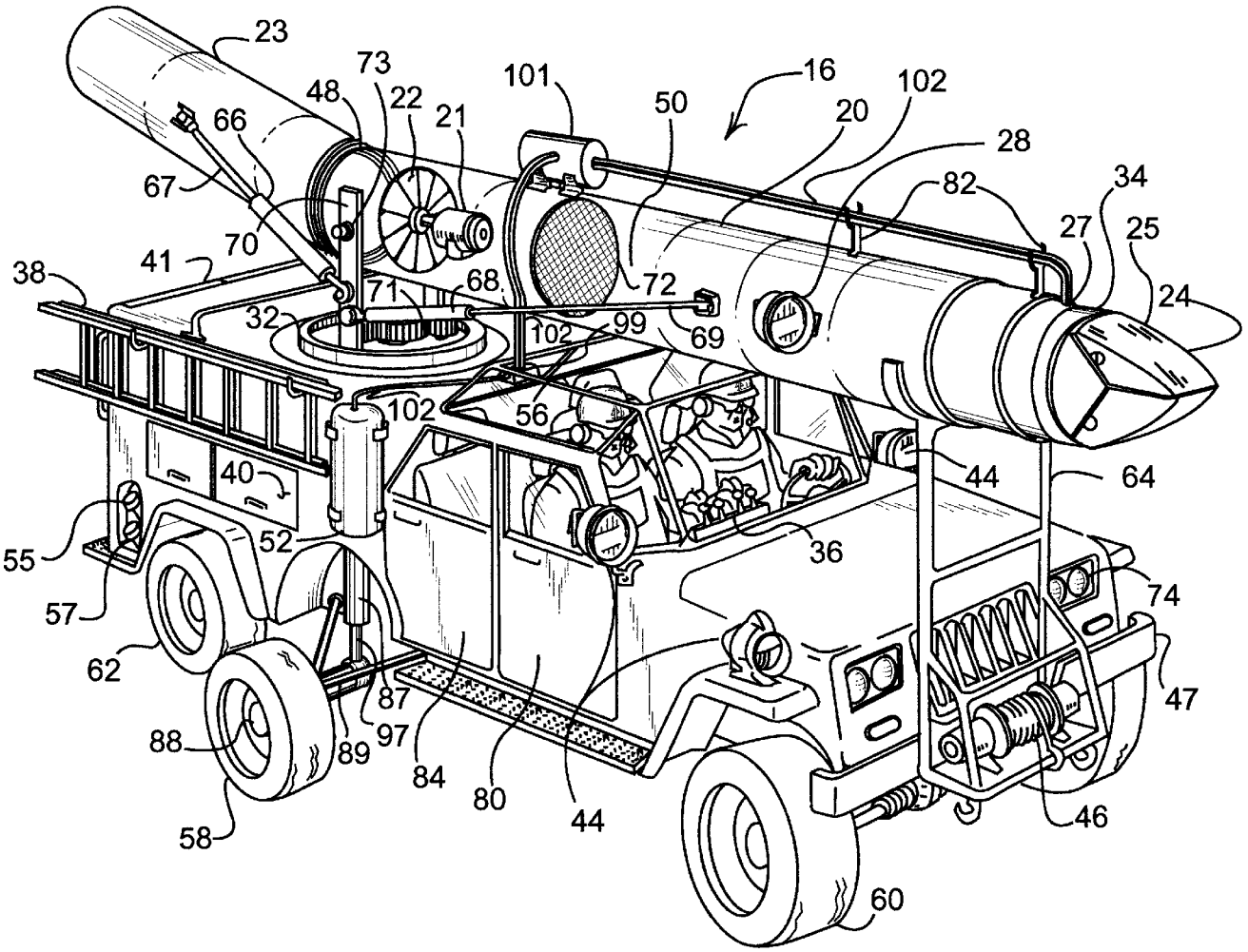
FIG. 1 is a right side perspective view of a vehicle incorporating the invention.

It should be understood that the following description of the presently preferred embodiments of the present invention is merely representative of many possible embodiments and thus is not intended to limit the scope of the present invention. In the following description, like structures will be referred to by similar numerical designations. In some figures, some features will be omitted to clarify the illustration of the remaining features.

Referring now to the drawings, a typical embodiment of a fire vehicle 16 incorporating the invention is illustrated in FIGS. 1 through 7. Front wheels 60 and rear wheels 62 are provided, preferably with drive power being available to all wheels on demand. Although wheels are shown for conventional support and drive means, tracks or other suitable support/drive means can be used as appropriate. The vehicle preferably has relatively high ground clearance, e.g. at least about 8 inches, to allow easy passage of rough terrain. Front doors 80 and rear doors 84 afford easy access for driver and crew.

The vehicle's most important component is an extensible evacuation tube 20 with exhaust section 23 and a nose cone 25 containing nose cone gates 24. The evacuation tube 20 can include at least two telescoping tubes, described below, or any other suitable means of extending the tube to greater length from the carrying and storage position shown. In transit, the tube is supported by support rack 64. The tube can be fabricated of light metals such as aluminum and alloys thereof, and/or high temperature polymer composites.

The tube is extended and retracted by power systems actuated remotely from driver's control panel 36, discussed below. The tube can be elevated above the horizontal plane, and depressed below same when trained over either side of the vehicle, by power units 66 and 68, discussed below. These mechanisms should be designed to allow elevation of the tube to at least about 45 degrees above the horizontal, and about 15 degrees below the horizontal. Fan or blower 22 is driven by motor 21, shown schematically in the center of the tube. Control panel 36 allows the operator to actuate the fan to evacuate air through the tube or to reverse the flow, at various rates. To minimize damage from hot gases and liquids, the motor can be located outside the tube and the fan driven remotely by mechanical means such as gears or chains (not shown here). (See, e.g., U.S. Pat. No. 1,926,298, which is incorporated herein by reference.)

The motor can be electrical, internal combustion or pneumatically driven, depending upon the prime mover of the vehicle and other power sources provided in the design. A power take-off from the vehicle can also be used, as described in U.S. Pat. No. 1,926,298. Suitable air-cooled internal combustion engines are widely available commercially. Small but powerful gas turbine units are also available and can be used. Similarly, the power for moving the tube in its various directions can be pneumatic, hydraulic, electrical, or suitable combinations thereof. Suitable connections for pressurized fluids, power and switching are provided, with due regard for the operating motions of the apparatus.

Turret 32 mounts the tube 20 on brackets 70 or the equivalent, and is capable of rotating by means of power-driven gears 71 to train the tube through at least 180 degrees, preferably about 360 degrees. Screen 72 is mounted upwind of the motor 21 and blower 22 within the tube 20 to trap debris. Floodlights or spotlights 28 are mounted in at least one suitable external position on the tube to illuminate the work area. Swivel joint 34, described below in FIGS. 9–11, allows the nose cone 25 of the tube 20 to be positioned vertically and laterally for aiming purposes. Nose cone gates 24 are normally closed while the vehicle is in transit or inactive, then opened as discussed below to allow smoke and gases to freely enter the tube. A screen 132 (shown in FIG. 10) can be provided in nose cone 25 to screen the entry to tube 20. The exhaust section 23 is elevated slightly to permit the tube to be elevated at least about 20 degrees without causing the exhaust section to strike the rear deck of the vehicle. Exhaust section 23 can be elevated and depressed about 40 degrees relative to tube 20 by power unit 66 and rod 67, by bending flexible joint 48. Flex joint 48 is fabricated of metal and high temperature fabrics or polymers. Greater elevation and depression of the tube 20 can be attained if it is trained to project over the side of the vehicle.

At least one external tank 52 of fire fighting materials (such as dry chemicals, carbon dioxide or water) is provided on the vehicle and connected to the tube via hoses 102 and junction 99. Hose retractor 101 is spring loaded and allows extra hose to pay out as tube 20 is elevated and/or trained or extended, then retracts ths hose as the tube again approaches the stow position. Hoses 102 extend along the top of tube 20 to carry fire extinguishing materials from tanks 52 and 54 plus water from tank 94 (shown in FIG. 7). These hoses are supported by at least one bracket 82, and can be extended from reel 101 when tube 20 is extended. Hoses 102 enter tube 20 and nose cone 25 at 27. When the smoke has been evacuated, the tube 20 can be extended and the nose cone 25 positioned to direct a flow of such fire fighting materials at the source of the fire through nozzle 75 (shown in FIG. 3), with the flow being actuated from control panel 36. Similarly, water can be pumped from tank 94 through hoses 102 to nozzle 76 in nose cone 25. Water and firefighting materials can be blown into the fire site by reversing the flow of motor 21 and fan 22. When evacuating smoke, water can be released from nozzle 76 to extinguish sparks and cool gases in passage through tube 20. Connections 55 and 57 are provided for filling the inner tanks.

Various accessory components can be provided on the vehicle which are common to fire fighting vehicles and assist the firefighters in using the invention effectively. For example, extension ladder 38 provides a useful feature. Various cabinets and storage areas 40 (on right side) and 41 (rear) are provided for firefighting tools and equipment. The vehicle provides a well-equipped driver/control compartment covered with a clear dome 56 which is fire and impact resistant to provide both protection and good visiblity for the crew. In addition to the driver/operator, space is provided for at least two additional firefighters to assist in operating the vehicle and fighting the fire. In addition to conventional headlights 74, the vehicle carries search/flood lights 44, which can be either permanently mounted (e.g., on the fender) or directionally controlled from the driver/operator compartment as is conventional in emergency vehicles. A power-driven winch 46 can be provided near the front bumper 47 to enable the vehicle to exert pulling force on other vehicles, portions of structures or the like. The winch can be used to remove window grilles from structures when necessary.

Extender wheels 58 can be extended laterally and adjusted vertically to provide support for the vehicle, as described in detail below. Pneumatic or hydraulic cylinders 87 and A-frames 89 are provided for this purpose. Wheels 58 allow the vehicle to be moved slightly when they are in place. The extender wheels 58 can be positioned to maintain the vehicle in a stable position even when it is necessary to park on sloping or irregular surfaces, and assist in maintaining the vehicle in position even when the tube 20 is trained out over the side and fully extended. Extender wheels 58 can also be used to stabilize the vehicle during sharp turns. In addition, sufficient ballast weight near the base of the vehicle (not shown) is provided so that the vehicle can remain level even when fuel and water tanks are empty and the tube 20 is trained and extended fully over one side or the other.

Figure 2:
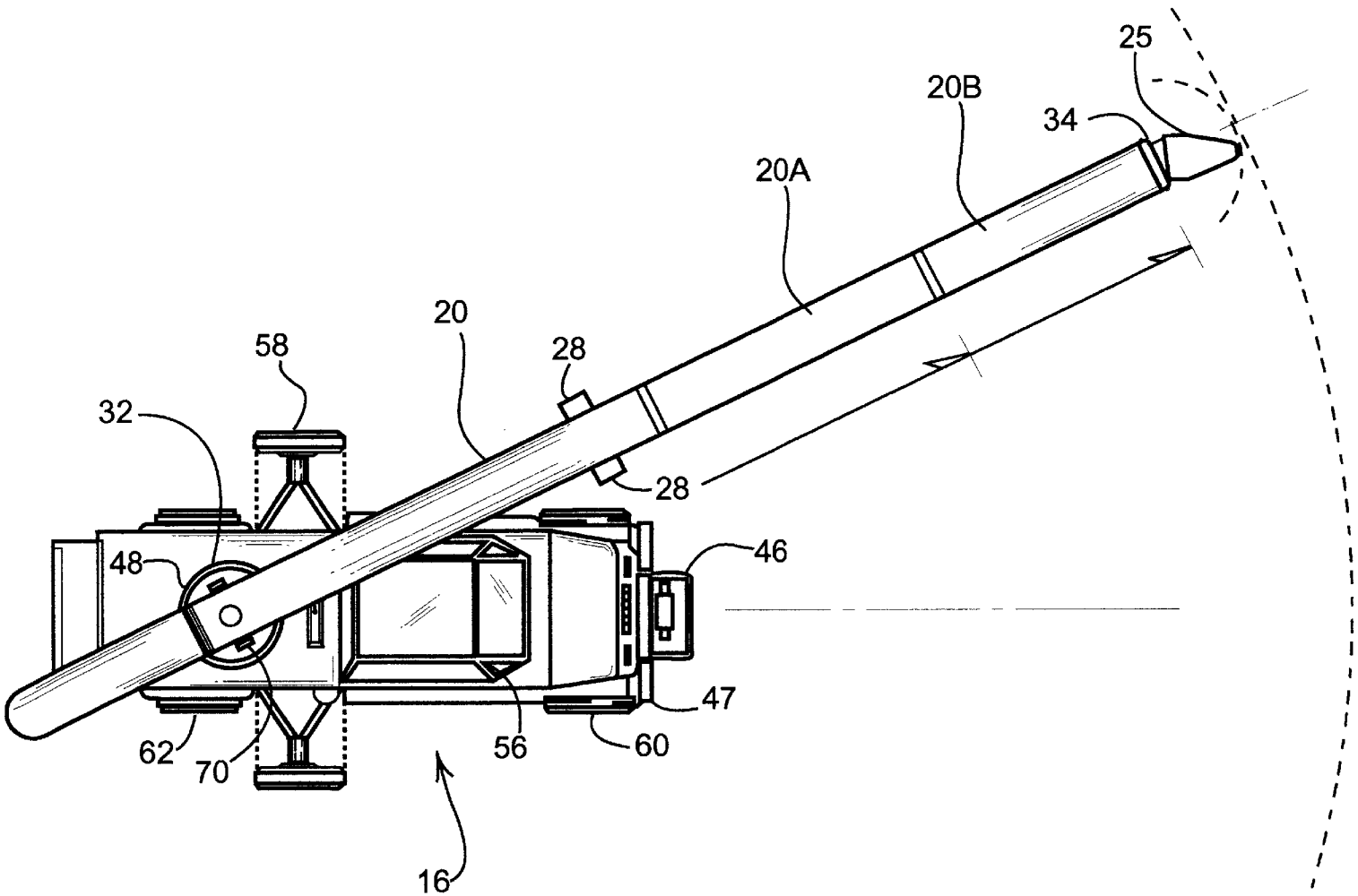
FIG. 2 is a top view of the vehicle illustrating the training and extension of the evacuation tube of the vehicle.
Figure 3:
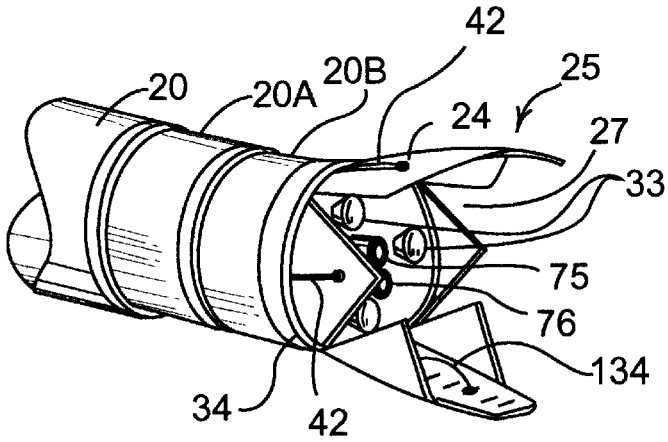
FIG. 3 is a detailed view of the tip of the evacuation tube.
Figure 3A:
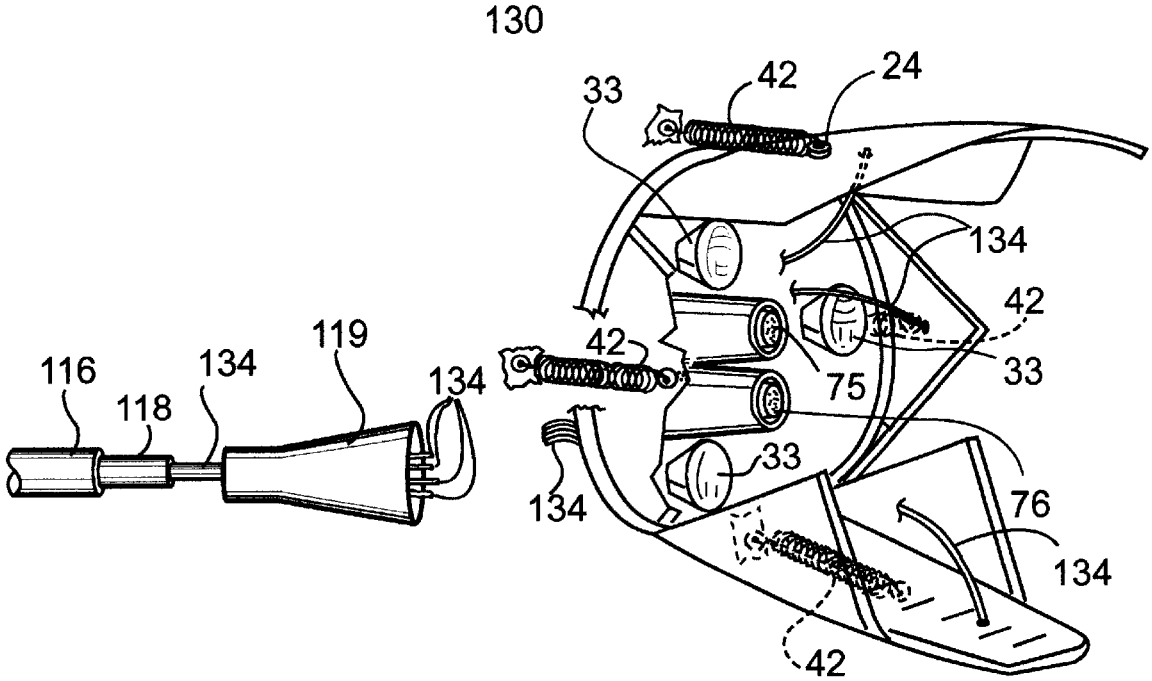
FIG. 3A is a detailed view of certain features at the tip of the evacuation tube.
Figure 4:
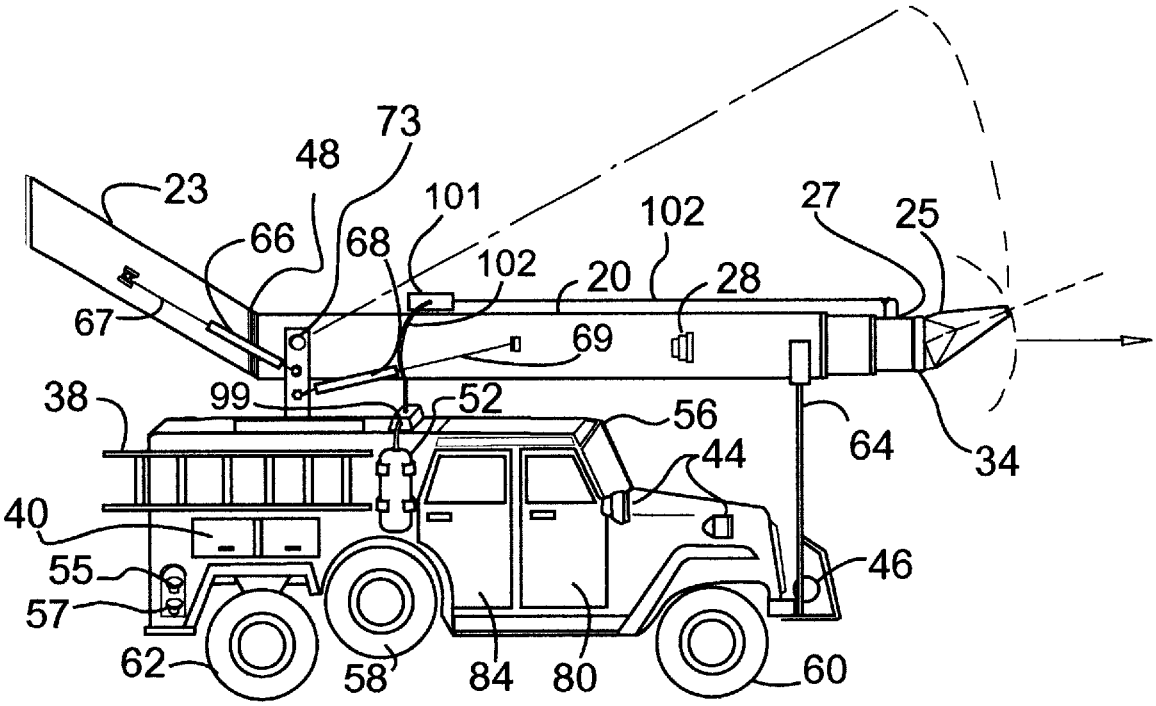
FIG. 4 is a side view of the vehicle.

As seen in FIG. 2 from overhead, tube 20 can be trained laterally via turret 32 and brackets 70. The tube can be extended so that telescoping tube sections 20A and 20B protrude, using the power equipment shown in FIG. 8 and discussed below. FIGS. 2 and 4 also illustrate the ability of nose cone 25 to be aimed laterally (as well as vertically) through swivel joint 34, as described in detail below. FIG. 3 shows the nose cone 25, tube 20 with telescoping tubes 20A and 20B partially extended, and nose cone gates 24 opened to allow smoke and gases to be sucked in. Gates 24 are hingedly attached to tube 20B. Nozzle 75 is placed to permit firefighting materials such as dry chemicals to be directed at the source of the fire when appropriate, being pumped from tank 52 via hoses 102. At least one floodlight 33 is provided inside the gates 24 to illuminate the target. A second nozzle 76 can pump water from inner tank 94. Exterior coil springs 42 are attached to swivel joint 34 and nose cone gates 24 to hold the gates open. Gate cables 134 are attached to the inner surfaces of each gate to close same, as discussed below. FIG. 3A illustrates additional features, discussed below in conjunction with FIG. 10.

Figure 5:
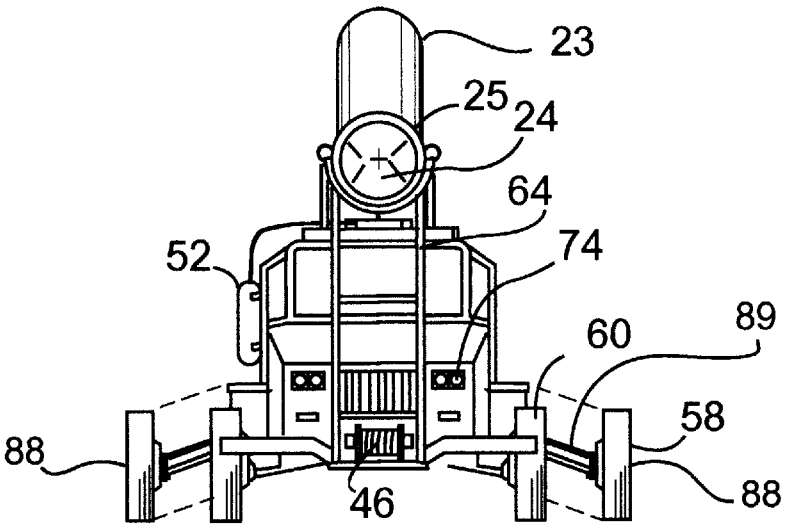
FIG. 5 is a front view of the vehicle with its extensible wheels extended and bracing the vehicle in place.
Figure 6:
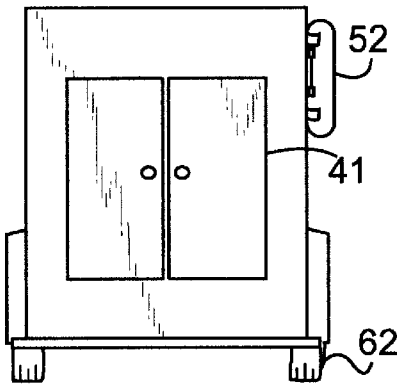
FIG. 6 is a rear view of the vehicle.

FIG. 4 shows the right side of the vehicle, with connections 55 and 57 for filling inner tanks 54 and 94. Nose cone 25 is elevated slightly, gates 24 closed and tube 20 is in the stowed position in bracket 64 for travel. Extender wheels 58 are retracted and fastened in elevated stowed positions above the ground for travel. Hoses 102 lead from hose reel 101 to enter tube 20 at 27, near nose cone 25. FIG. 5, a front view of the vehicle, shows extender wheels 58 in the extended position, touching the ground to stabilize the vehicle's position. A frames 89 and stub axles 88 support the wheels. Cylinder 68 is actuated to elevate or depress tube 20 via rod 69. Tube 20 pivots about pin 73 in bracket 70.

Figure 7A:
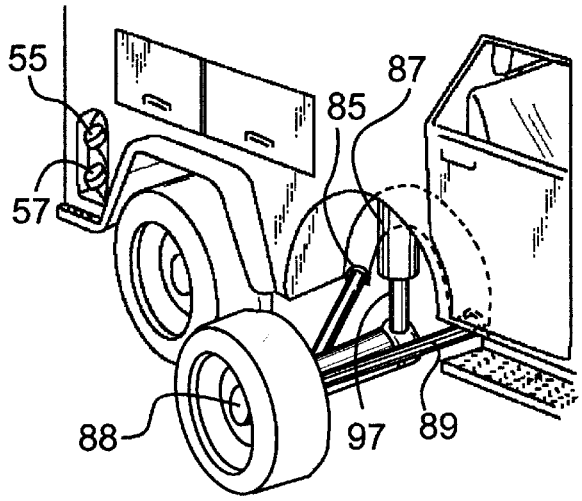
FIG. 7A is a detail view of the extender wheel mechanism of FIG. 7.
Figure 7:
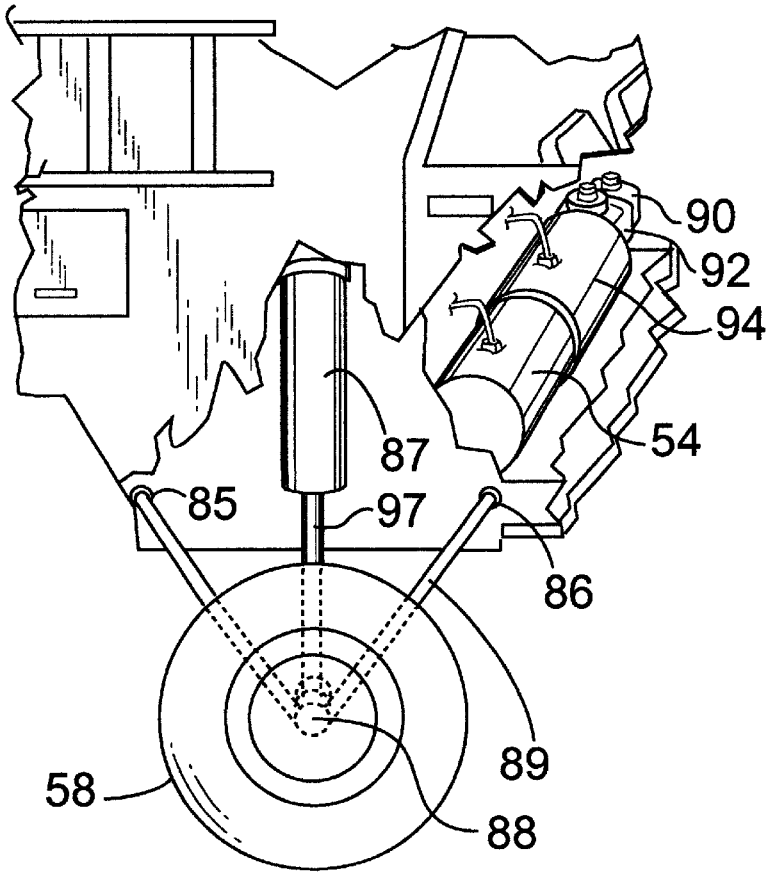
FIG. 7 is a side view of the vehicle, cut away to reveal pneumatic equipment.

FIG. 7, a right side partial cutaway view of the vehicle, provides a schematic illustration of a 24 volt generator 90 which can be powered by electrical or gas motors or gas turbines, air compressor 92, water tank 94 and fire extinguisher tank 54, all mounted behind the crew seats and below the rear deck to take full advantage of this space. The generator 90 provides auxiliary power for various units as needed through suitable wiring and connections. Air compressor 92 provides compressed air at suitable pressures up to about 100 psi to actuate various pneumatic components including the extenders for tube 20, nose cone gates 24, swiveling nose cone 25 around swivel joint 34, the training of turret 32 and elevation of tube 20 and exhaust section 23. The air compressor is also driven by a suitable power source as discussed above. Water tank 94 contains at least about 100 gallons of water for use in tube nozzle 75 and other applications. The tank should contain baffles inside to prevent sloshing water from affecting the balance of the vehicle, especially in transit. Water can also be piped into tank 94 from a hydrant connection or other source via connection 55 to prevent running out of water in extended missions. Fire extinguisher tank 54 can be recharged via connection 57.

Extender wheel 58 is shown in the extended position, with rear wheels 62 omitted for clarity. Extender wheel 58 is mounted on a stub axle 88 attached to A-frame 89, which is hingedly connected to the vehicle body at 85 and 86. Wheels 58 are extended and lowered into operating position by pneumatic cylinder 87 and rod 97. Conventional suspension equipment (not shown) ensures that the extender wheels 58 are in vertical position when they are raised and stowed and when they are lowered to the ground.

Figure 8:
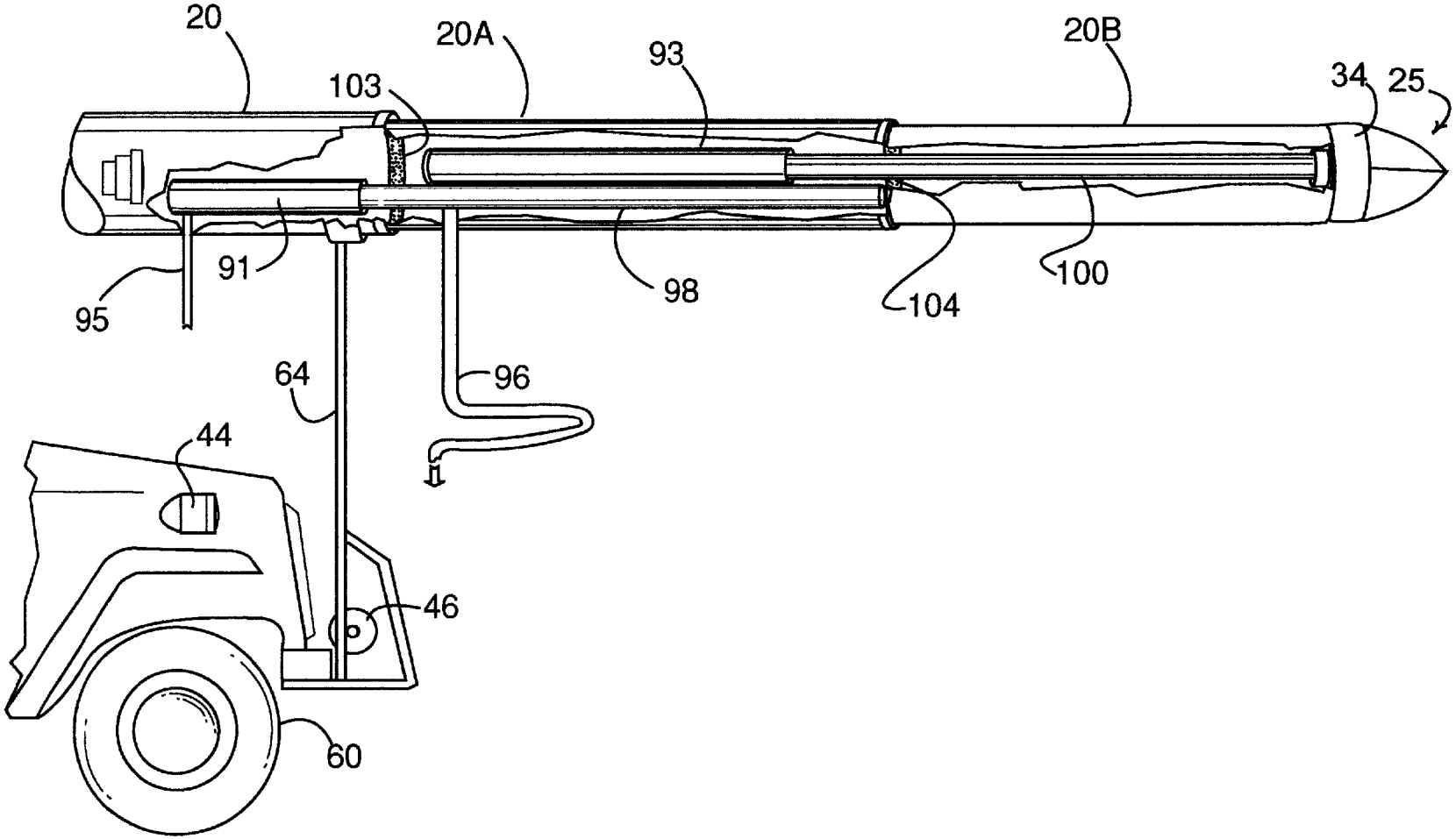
FIG. 8 is a detailed cutaway view of the evacuation tube in extended position.

Tube 20 contains at least one telescoping tube within which can be extended and retracted, shown in this embodiment as tubes 20A and 20B. Although any suitable power source can be used for the extension and retraction, including hydraulics, magnetics or mechanical springs, FIG. 8 illustrates schematically a pneumatic system for this operation. Tubes 20, 20A and 20B are arranged in a telescoping relationship which permits easy extension and retraction. Suitable seals (not shown) can be provided to keep dirt and moisture from penetrating the spaces between the tubes. Separate air cylinders 91 and 93 (which can be mounted within or outside the cylinders) are provided with compressed air via hoses 95 and 96 to extend ramrods 98 and 100. These ramrods connect to the telescoping tubes via reinforcing bands 103 and 104 so that extension of the ramrods also extends the tubes. Compressed air is provided from compressor 92 via suitable valving and controls (not shown), actuated from control panel 36. Air cylinders 91 and 93 are fitted with reversible air plungers (not shown) which can be activated from control panel 36 to retract rods 98 and 100 and tubes 20A and 20B. The tube asembly can be extended to lengths which permit the vehicle to retain a stable position, e.g. at least about thirty feet. The outermost tube (here, 20B) connects to swivel joint 34 for nose cone 25.

Figure 10:
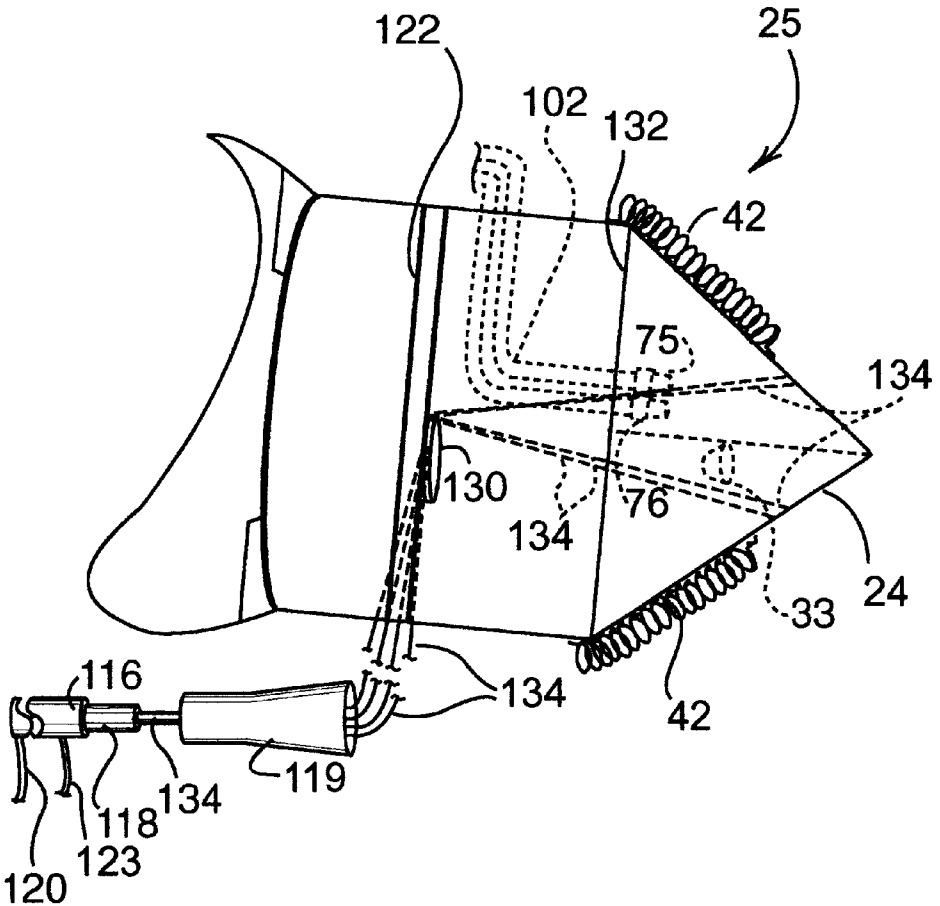
FIG. 10 is a cutaway view illustrating the mechanism for opening the nose cone gates of the evacuation tube.
Figure 9:
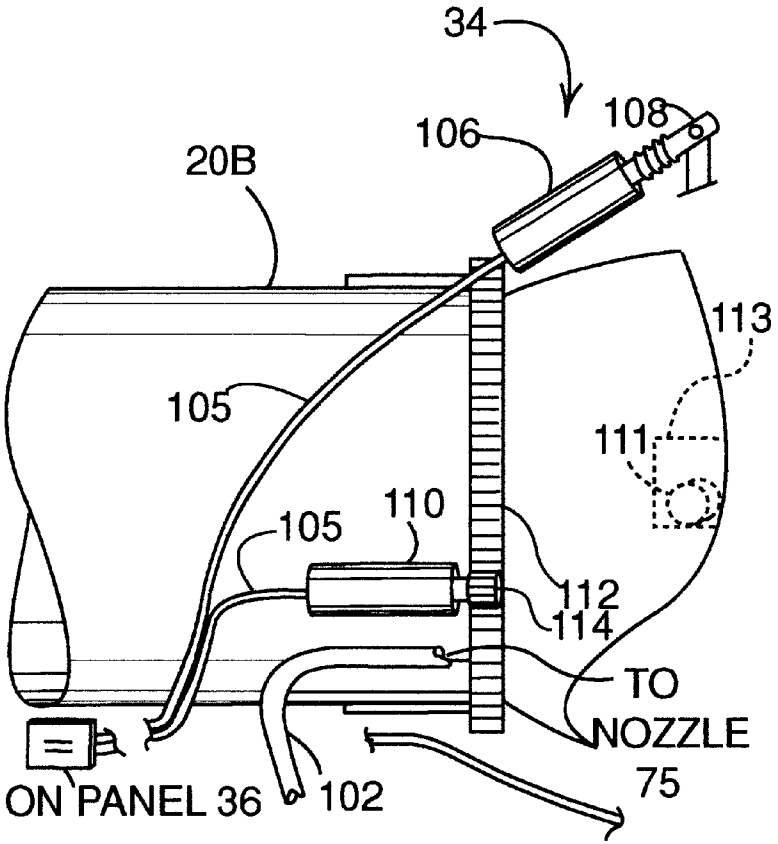
FIG. 9 is a schematic view illustrating drive mechanisms for the evacuation tube.

FIGS. 9 and 10 provide a schematic illustration of the operation of swivel joint 34. This joint could be described as a wrist joint, since it rotates and bends to provide both lateral and vertical aiming of nose cone 25. Electrical power lines 105 are actuated by a switch or switches on control panel 36, providing power to electric motors 106 and 110. These motors drive screw drive 108 and spur gear 114 plus ring gear 112, to deflect and rotate nose cone 25, respectively. Nose cone 25 is deflected via axle 111 and hinge 113. Thus, the nose cone 25 can be deflected up to about fifteen degrees from the center line of the tube, laterally and/or vertically, to aim it precisely at an opening in a structure and/or at a fire source. Hoses 102 enter tube 20B just behind swivel joint 34 and emerge within nose cone 25 to feed water and other firefighting materials through nozzles 76 and 75, respectively, when gates 24 are open.

Figure 11:
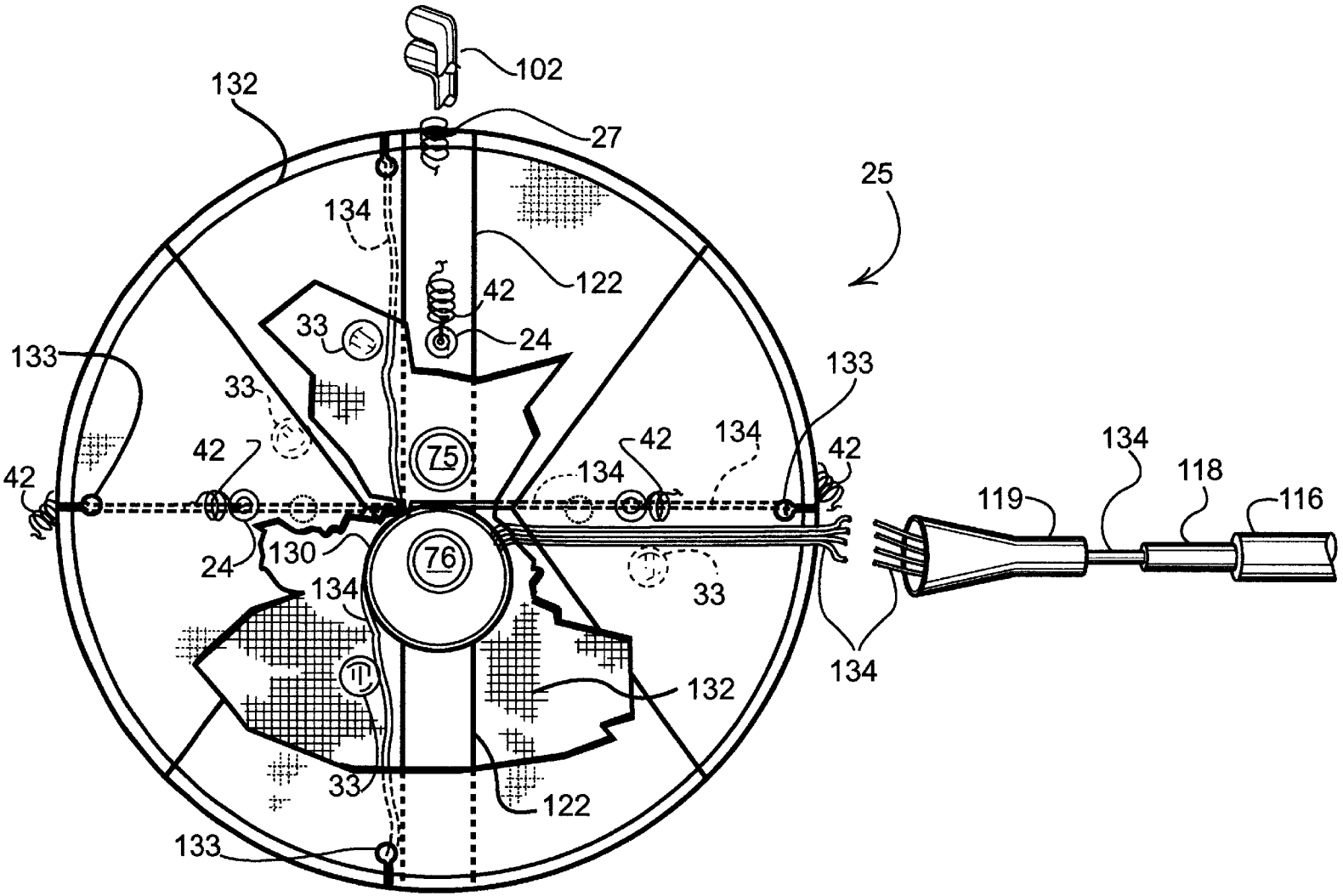
FIG. 11 is an end view of the evacuation tube with nose cone gates closed.

FIGS. 10 and 11 provide a side sectional view and an end view of nose cone 25 with nose cone gates 24 closed. Gates 24 are spring (42) loaded to remain open when in use, as described above, and are pneumatically actuated to close and remain closed via air cylinder 116 and rod 118, receiving air from compressor 92 via line 123 and activated via electrical line 120 and switch 160 from control panel 36. Center bar 122 occupies the center portion of screen 132 and mounts pulley 130. Gate cables 134 pass from the inner surfaces of gates 24 to pulley 130, via guides 133 (shown in FIG. 11), are collected and bunched by collector 119 after leaving pulley 130 together, and can then be pulled by rod 118 to close gates 24 when cylinder 116 is activated.

At least one floodlight 33 can be activated from control panel 36 to illuminate the fire scene. A coarse, durable metal screen (say, about 1" mesh) 132 is mounted just inside the gates 24 to prevent large debris from entering. Nozzles 75 and 76 are fed by hoses 102 and can also be activated from control panel 36 when gates 24 are open to direct fire extinguishing materials and/or water to the fire source.

Figure 12:
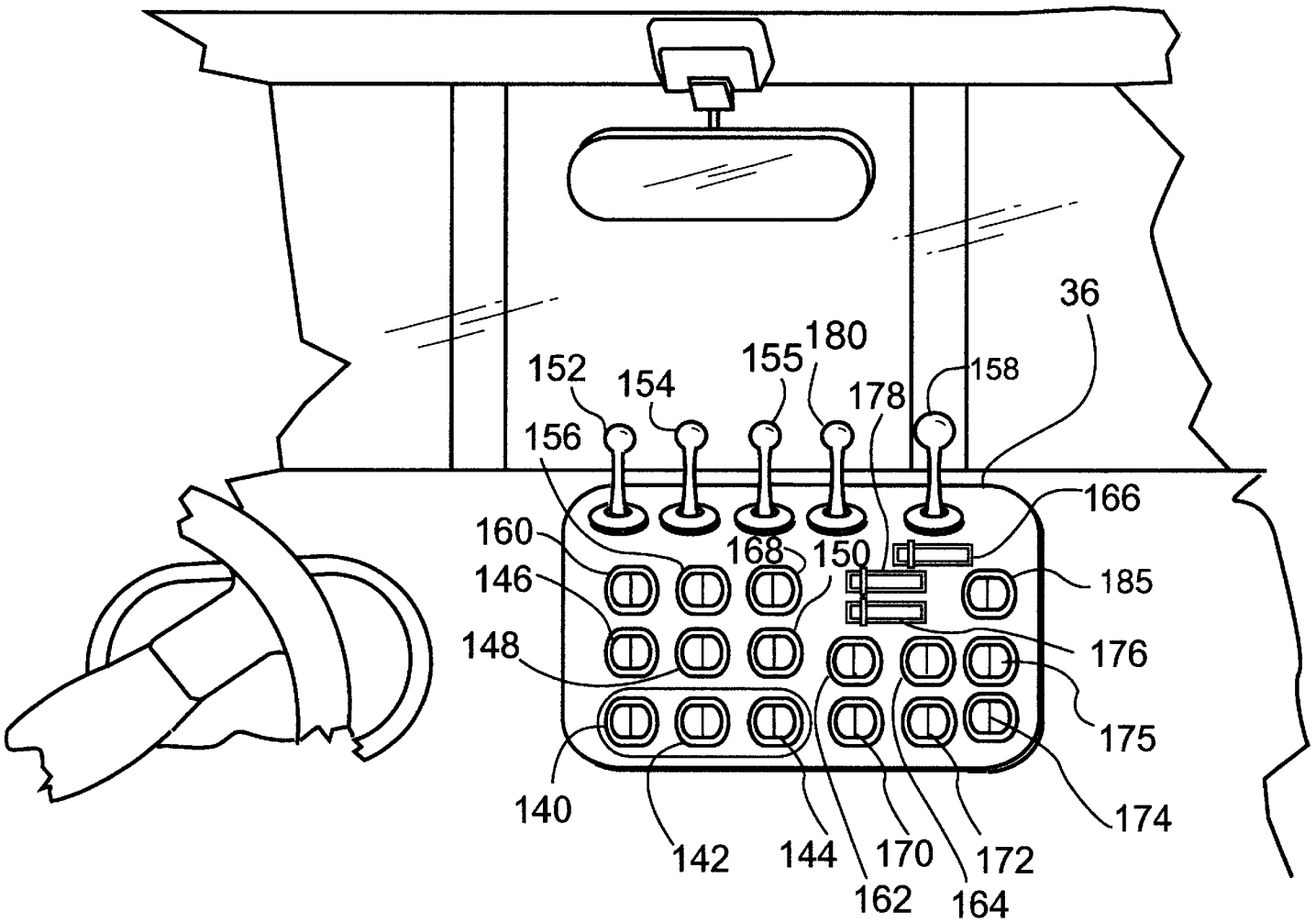
FIG. 12 is a schematic view of the control panel.

FIG. 12 illustrates control panel 36, providing a schematic depiction of the controls for the various systems. Control panel 36 consolidates all controls for smoke evacuation and firefighting systems in a position on the vehicle dashboard which can be easily reached by either the driver or a crewman in the passenger seat. Separate controls are provided for activating the systems and operating same. The controls can take any suitable form, including levers, joysticks, toggle switches and buttons. Related controls for the various systems are grouped together.

Separate lighting switches 140, 142 and 144 are provided for the spotlights 44 (fender mounted), 28 (outside tube mounted) and 33 (mounted inside tube). Switches 146, 148 and 150 activate the systems for elevating plus extending/retracting tube 20 and for training turret 32. Control 152, preferably a lever, is used for elevating and lowering the tube, e.g. by pulling back to elevate, pushing forward to lower same. Another lever or other suitable control 154 is used to extend and retract the tubes, again by pressing forward to extend and pulling back to retract. Control 155 is used to train turret 32 and the associated tubes. The control can be a simple three-position lever to train right or left or stop, but can optionally include a dial on which the desired final position of the tube relative to the front centerline of the vehicle can be set, with the training mechanism automatically training the tube to that position. Such synchro/servo systems are commercially available.

Switch 156 activates power to the aiming mechanism of nose cone 25, and a joystick or other suitable control 158 permits the nose cone to be aimed up, down, right, left or any combination thereof. Switch 160 closes the nose cone gates 24 against the spring pressure which keeps them open while in use evacuating smoke, etc. Conventional switches 168 and 170 activate motor 21 and fan 22 in evacuation or blowing modes, and provide at least three speeds for such actions, including reverse.

Aimable spotlights 44 (not shown here) mounted adjacent the driver and passenger doors are conventional emergency vehicle units with power switches and manual means for aiming in any direction (not shown). Power switch 162 and conventional controls 164 activate and control electric winch 46. Switches 172 and 174 activate generator 90 and air compressor 92.

Switch 175 activates the power system for extending extender wheels 58, and lever 176 is used for extending and retracting them to the stowed position or to touch the ground. Additional controls are provided for conventional operation of the vehicle, emergency lights/sirens (not shown) and any additional accessory devices which may be provided to improve the operation of the vehicle. Switch 185 activates cylinder 66 for raising and lowering exhaust section 23, with joystick 180 used to actuate the system.

As can be seen by any firefighter, the vehicle of this invention is very useful and versatile in combating fires and other emergencies. In operation, typically the vehicle will approach the scene, park, and allow the firefighters (preferably about three in addition to the driver) to debark. The driver remains in communications with the firefighters, other vehicles and headquarters via the usual emergency radio systems. While the driver positions the vehicle near a suitable entry point for breaching the structure and prepares the tube for extension, the firefighters approach the structure and break out accessible windows and doors to allow air to enter the burning structure. If metal window grilles or the like need to be removed, the vehicle winch can be used to assist. They then assist and guide the driver/operator in extending the tube and directing it into an open window or other aperture. The firefighters can break open a window for the tube if accessible; otherwise, the tube itself can be extended into the window to break open a path. Once the tube is inside the structure, the nose cone is aimed as necessary or appropriate, the nose cone gates are opened and the driver/operator applies the degree of suction appropriate, based upon observations by the entire crew. Water is pumped through nozzle 76 to cool smoke and gases. When sufficient smoke and hot gases have been evacuated, the firefighters can enter the structure to rescue occupants, fight the fire and perform other critical tasks. The tube can be further employed by providing ilumination, firefighting materials directed to the fire source or even blowing in air and/or mist generated from the water from nozzle 76.

Various changes and modifications to the presently preferred embodiments will be apparent to those skilled in the art. Such changes and modifications may be made without departing from the spirit and scope of the present invention and without diminishing its attandent advantages. Therefore, the appended claims are intended to cover such changes and modifications, and are the sole limits on the scope of the invention.

I claim:

1. A self-propelled evacuating fire vehicle comprising an extensible evacuation tube having an entry portion and operatively connected to mechanical suction means contained within said tube and including means for positioning said tube for entry into an opening in a burning structure.

2. The vehicle of claim 1, further comprising power means remotely actuated by an operator of said vehicle to extend and retract said evacuation tube.

3. The vehicle of claim 1, further comprising power means remotely actuated by an operator of said vehicle to train said evacuation tube right or left and elevate or depress same.

4. The vehicle of claim 1 wherein said evacuation tube is extended and retracted via at least one tube which telescopes within a main tube.

5. The vehicle of claim 1 wherein said suction means comprise at least one motor and at least one fan.

6. The vehicle of claim 1 wherein said evacuation tube comprises an exhaust section forming an obtuse angle to the entry portion thereof to allow elevation of said evacuation tube.

7. The vehicle of claim 6 wherein said exhaust section is attached to said evacuation tube by a flexible joint and can be independently elevated and depressed.

8. The vehicle of claim 1 which comprises extension wheels which are adapted to be extended and lowered into positions touching the ground on either side of the vehicle to stabilize it in operation.

9. The vehicle of claim 1 which has at least four drive wheels.

10. The vehicle of claim 5 wherein said evacuation tube contains at least one debris screen which is positioned upwind of said fan.

11. A self-propelled fire vehicle comprising an extensible evacuation tube operatively connected to mechanical suction means and including means for positioning said tube for entry into an opening in a burning structure, wherein said evacuation tube comprises a nose cone having means for movement in the horizontal and vertical planes by power means remotely actuated by an operator of said vehicle.

12. The vehicle of claim 11 wherein said nose cone comprises gates which are maintained in an open position by spring means and equipped for closing by power means remotely actuated by an operator of said vehicle.

13. The vehicle of claim 12 wherein said evacuation tube comprises at least one device selected from the group consisting of floodlights and nozzles for fire extinguishing materials, said devices(s) being placed in said nose cone and exposed for operation when said nose cone gates are open.

14. The vehicle of claim 13 wherein said evacuation tube comprises a nozzle which is operatively connected to a source of firefighting materials and equipped to be activated by an operator of said vehicle.

15. The vehicle of claim 13 wherein said evacuation tube comprises a nozzle which is connected to a source of water and equipped to be activated by an operator of said vehicle to cool gases entering said tube.

16. A method of firefighting employing the vehicle of claim 12 which comprises steps of:

a) positioning said vehicle adjacent a burning structure where a window or other aperture is nearby;

b) breaking open said aperture;

c) closing said evacuation tube;

d) extending said evacuation tube into said aperture;

e) opening said evacuation tube;

f) activating said suction means to evacuate smoke from said structure; and g) allowing firefighting vehicles and personnel to attack fire(s) in the structure when the smoke has been evacuated.

17. The method of claim 16, comprising a further step of introducing firefighting materials into said structure via said evacuation tube when said smoke has been evacuated.

18. The method of claim 16 wherein water is pumped through said evacuation tube to cool said smoke which is evacuated from said structure.

19. The method of claim 16 wherein water is pumped through said tube and blown into said structure as a mist by reversing said suction means.

20. The vehicle of claim 11 wherein said evacuation tube contains at least one debris screen which is positioned in said nose cone.

21. The vehicle of claim 4, wherein said mechanical suction means can be reversed and the suction rate varied.

22. A self-propelled evacuating fire vehicle comprising:

a) an evacuation tube which is equipped to be extended and retracted, trained laterally and elevated and depressed, all by power means remotely actuated by an operator of said vehicle;

b) extendible support wheels which are equipped to be extended on both sides of said vehicle and lowered into contact with the ground to support and stabilize said vehicle in operation; and c) power suction means operatively connected to said evacuation tube.

23. The vehicle of claim 22, wherein said evacuation tube comprises a nose cone having power means remotely actuated by an operator of said vehicle to:

a) aim said nose cone in the horizontal and vertical planes; and b) open and close said nose cone.

24. The vehicle or claim 22, wherein said suction means are contained within said evacuation tube.

* * * * *

UNITED STATES PATENT AND TRADEMARK OFFICE

CERTIFICATE OF CORRECTION

PATENT NO. : 6,446,731 B1
DATED : September 10, 2002
INVENTOR(S) : Joseph J. Sorosky It is certified that error appears in the above-identified patent and that said Letters Patent is hereby corrected as shown below:

Title page,
Item [73], omit "Assignee" line in its entirety.

Signed and Sealed this

Twenty-fourth Day of December, 2002

JAMES E. ROGAN
*Director of the United States Patent and Trademark Office*